US011564287B2

(12) United States Patent
Jobanputra et al.

(10) Patent No.: US 11,564,287 B2
(45) Date of Patent: Jan. 24, 2023

(54) CARTRIDGES WITH VAPORIZABLE MATERIAL INCLUDING AT LEAST ONE IONIC COMPONENT

(71) Applicant: JUUL Labs, Inc., San Francisco, CA (US)

(72) Inventors: Rishi D. Jobanputra, Harrow (GB); Christopher James Rosser, Cambridge (GB); James P. Westley, Cambridge (GB)

(73) Assignee: JUUL Labs, Inc., San Francisco, CA (US)

( * ) Notice: Subject to any disclaimer, the term of this patent is extended or adjusted under 35 U.S.C. 154(b) by 542 days.

(21) Appl. No.: 16/674,633

(22) Filed: Nov. 5, 2019

(65) Prior Publication Data

US 2020/0138116 A1 May 7, 2020

Related U.S. Application Data

(60) Provisional application No. 62/755,929, filed on Nov. 5, 2018.

(51) Int. Cl.
*A24F 13/00* (2006.01)
*A24F 17/00* (2006.01)
(Continued)

(52) U.S. Cl.
CPC ..... *H05B 1/0297* (2013.01)

(58) Field of Classification Search
CPC ..... A24B 15/167; A24F 40/10; A24F 40/42; A24F 40/46; H05B 1/0297
See application file for complete search history.

(56) References Cited

U.S. PATENT DOCUMENTS 4,947,875 A 8/1990 Brooks et al.
5,060,671 A 10/1991 Counts et al.
(Continued)

FOREIGN PATENT DOCUMENTS

AT 507187 A4 3/2010
CA 3009050 C 6/2020
(Continued)

*Primary Examiner* — Abdullah A Riyami
*Assistant Examiner* — Thang H Nguyen
(74) *Attorney, Agent, or Firm* — Mintz Levin Cohn Ferris Glovsky and Popeo, P.C.

(57) ABSTRACT

Cartridges for vaporizer devices are provided. In one exemplary embodiment, the cartridge can include a reservoir being configured to contain a liquid vaporizable material that includes at least one ionic component, an airflow tube that extends though the reservoir and defines an airflow passageway therethrough, and first and second electrodes. The airflow tube includes a wicking element that is in fluid communication with the reservoir, in which the wicking element is configured to substantially draw at least a portion of the liquid vaporizable material from the reservoir into the airflow passageway. The first and second electrodes are positioned substantially on or adjacent to opposite surfaces of the wicking element, in which the liquid vaporizable material received within the wicking element is substantially vaporized in response to generation of a potential difference between the first and second electrodes. Vaporizer devices are also provided.

20 Claims, 3 Drawing Sheets

(51) Int. Cl.
*A24F 25/00* (2006.01)
*H05B 1/02* (2006.01)

(56) References Cited

U.S. PATENT DOCUMENTS 5,144,962 A 9/1992 Counts et al.
5,249,586 A 10/1993 Morgan et al.
5,269,327 A 12/1993 Counts et al.
5,322,075 A 6/1994 Deevi et al.
5,372,148 A 12/1994 McCafferty et al.
5,505,214 A 4/1996 Collins et al.
5,666,978 A 9/1997 Counts et al.
6,747,573 B1 6/2004 Gerlach et al.
6,909,840 B2 6/2005 Harwig et al.
8,833,364 B2 9/2014 Buchberger
8,881,737 B2 11/2014 Collett et al.
8,910,640 B2 12/2014 Sears et al.
9,167,853 B2 10/2015 Xiang
9,197,726 B2 11/2015 Stanimirovic et al.
9,247,773 B2 2/2016 Memari et al.
9,399,110 B2 7/2016 Goodman et al.
9,423,152 B2 8/2016 Ampolini et al.
9,549,573 B2 1/2017 Monsees et al.
9,572,372 B2 2/2017 Liu
9,602,646 B2 3/2017 Stanimirovic et al.
9,655,383 B2 5/2017 Holzherr et al.
9,668,522 B2 6/2017 Memari et al.
9,674,894 B2 6/2017 Schneider et al.
9,743,691 B2 8/2017 Minskoff et al.
9,770,055 B2 9/2017 Cameron et al.
9,772,245 B2 9/2017 Besling et al.
9,801,414 B2 10/2017 Liu
9,877,519 B2 1/2018 Xiang
10,004,259 B2 6/2018 Sebastian et al.
10,039,321 B2 8/2018 Verleur et al.
10,045,568 B2 8/2018 Monsees et al.
10,058,122 B2 8/2018 Steingraber et al.
10,058,128 B2 8/2018 Cameron et al.
10,058,129 B2 8/2018 Monsees et al.
10,085,481 B2 10/2018 Verleur et al.
10,085,486 B2 10/2018 Cameron
10,111,470 B2 * 10/2018 Monsees ..... H05B 3/04
10,117,465 B2 11/2018 Monsees et al.
10,117,466 B2 11/2018 Monsees et al.
10,130,123 B2 11/2018 Hatton et al.
10,130,780 B2 11/2018 Talon
10,131,532 B2 11/2018 Murison et al.
10,194,693 B2 2/2019 Wensley et al.
10,231,486 B2 3/2019 Bowen et al.
10,398,176 B2 9/2019 Hon et al.
10,555,552 B2 * 2/2020 Batista ..... A24F 40/40
2003/0005926 A1 1/2003 Jones et al.
2005/0022806 A1 2/2005 Beaumont et al.
2013/0255702 A1 10/2013 Griffith et al.
2014/0041655 A1 2/2014 Barron et al.
2014/0041658 A1 2/2014 Goodman et al.
2014/0123989 A1 5/2014 LaMothe
2014/0144429 A1 5/2014 Wensley et al.
2014/0150810 A1 6/2014 Hon
2014/0190496 A1 7/2014 Wensley et al.
2014/0202474 A1 7/2014 Peleg et al.
2014/0238424 A1 8/2014 Macko et al.
2014/0299137 A1 10/2014 Kieckbusch et al.
2014/0334804 A1 11/2014 Choi
2014/0345635 A1 11/2014 Rabinowitz et al.
2015/0027471 A1 1/2015 Feldman et al.
2015/0027472 A1 1/2015 Amir
2015/0027473 A1 1/2015 Graf
2015/0059780 A1 3/2015 Davis et al.
2015/0075546 A1 3/2015 Kueny, Sr. et al.
2015/0107609 A1 4/2015 Liu
2015/0122274 A1 5/2015 Cohen et al.
2015/0122278 A1 5/2015 Hardgrove et al.
2015/0136158 A1 5/2015 Stevens et al.
2015/0216237 A1 8/2015 Wensley et al.
2015/0245654 A1 9/2015 Memari et al.
2015/0245655 A1 9/2015 Memari et al.
2015/0245657 A1 9/2015 Memari et al.
2015/0245662 A1 9/2015 Memari et al.
2015/0245665 A1 9/2015 Memari et al.
2015/0245666 A1 9/2015 Memari et al.
2015/0245667 A1 9/2015 Memari et al.
2015/0245668 A1 9/2015 Memari et al.
2015/0245669 A1 * 9/2015 Cadieux ..... A24F 40/42 131/329
2015/0257447 A1 9/2015 Sullivan
2015/0272222 A1 10/2015 Spinka et al.
2015/0305409 A1 10/2015 Verleur et al.
2015/0320116 A1 11/2015 Bleloch et al.
2015/0335074 A1 11/2015 Leung
2015/0366266 A1 12/2015 Chen
2016/0007653 A1 1/2016 Tu
2016/0018347 A1 1/2016 Drbal et al.
2016/0051716 A1 2/2016 Wheelock et al.
2016/0053988 A1 2/2016 Quintana
2016/0091194 A1 3/2016 Liu
2016/0138795 A1 5/2016 Meinhart et al.
2016/0150824 A1 6/2016 Memari et al.
2016/0166786 A1 6/2016 Kinzer
2016/0198766 A1 7/2016 Liu
2016/0206002 A1 7/2016 Borkovec et al.
2016/0219933 A1 8/2016 Henry et al.
2016/0233705 A1 8/2016 Liu
2016/0233708 A1 8/2016 Liu
2016/0235119 A1 8/2016 Liu
2016/0249684 A1 9/2016 Liu
2016/0268824 A1 9/2016 Liu
2016/0278436 A1 9/2016 Verleur et al.
2016/0324217 A1 11/2016 Cameron
2016/0334847 A1 11/2016 Cameron et al.
2016/0345627 A1 12/2016 Liu
2016/0345628 A1 12/2016 Sabet
2016/0356751 A1 12/2016 Blackley
2016/0363570 A1 12/2016 Blackley
2016/0363917 A1 12/2016 Blackley
2016/0366933 A1 12/2016 Liu
2016/0367925 A1 12/2016 Blackley
2016/0370335 A1 12/2016 Blackley
2016/0374393 A1 12/2016 Chen
2016/0374397 A1 12/2016 Jordan et al.
2016/0374398 A1 12/2016 Amir
2017/0018000 A1 1/2017 Cameron
2017/0020188 A1 1/2017 Cameron
2017/0020191 A1 1/2017 Lamb et al.
2017/0020195 A1 1/2017 Cameron
2017/0020196 A1 1/2017 Cameron et al.
2017/0020197 A1 1/2017 Cameron et al.
2017/0027229 A1 2/2017 Cameron et al.
2017/0027234 A1 2/2017 Farine et al.
2017/0042230 A1 2/2017 Cameron
2017/0042231 A1 2/2017 Cameron
2017/0042243 A1 2/2017 Plojoux et al.
2017/0045994 A1 2/2017 Murison et al.
2017/0046357 A1 2/2017 Cameron
2017/0046738 A1 2/2017 Cameron
2017/0055588 A1 3/2017 Cameron et al.
2017/0079321 A1 3/2017 Golz
2017/0086496 A1 3/2017 Cameron
2017/0086497 A1 3/2017 Cameron
2017/0086503 A1 3/2017 Cameron et al.
2017/0086504 A1 3/2017 Cameron
2017/0091853 A1 3/2017 Cameron
2017/0092106 A1 3/2017 Cameron
2017/0092900 A1 3/2017 Yang
2017/0093960 A1 3/2017 Cameron
2017/0093981 A1 3/2017 Cameron
2017/0108210 A1 4/2017 Meinhart et al.
2017/0112194 A1 4/2017 Sur et al.
2017/0119052 A1 5/2017 Williams et al.
2017/0119053 A1 5/2017 Henry et al.
2017/0119058 A1 5/2017 Cameron et al.
2017/0135407 A1 5/2017 Cameron
2017/0135408 A1 5/2017 Cameron et al.
2017/0135409 A1 5/2017 Cameron et al.

(56) References Cited

U.S. PATENT DOCUMENTS

| | | | | |
|---|---|---|---|---|
| 2017/0135411 | A1 | 5/2017 | Cameron | |
| 2017/0135412 | A1 | 5/2017 | Cameron | |
| 2017/0136193 | A1 | 5/2017 | Cameron | |
| 2017/0136194 | A1 | 5/2017 | Cameron | |
| 2017/0136301 | A1 | 5/2017 | Cameron | |
| 2017/0188627 | A1 | 7/2017 | Sur | |
| 2017/0196263 | A1 | 7/2017 | Sur | |
| 2017/0208863 | A1 | 7/2017 | Phillips et al. | |
| 2017/0215484 | A1 | 8/2017 | Xiang | |
| 2017/0219391 | A1 | 8/2017 | Lin et al. | |
| 2017/0251718 | A1 | 9/2017 | Armoush et al. | |
| 2017/0251725 | A1 | 9/2017 | Buchberger et al. | |
| 2017/0280771 | A1 | 10/2017 | Courbat et al. | |
| 2017/0290371 | A1 | 10/2017 | Davis et al. | |
| 2017/0294804 | A1 | 10/2017 | Sur | |
| 2017/0302324 | A1 | 10/2017 | Stanimirovic et al. | |
| 2017/0303590 | A1 | 10/2017 | Cameron et al. | |
| 2017/0303597 | A1 | 10/2017 | Tsui | |
| 2017/0325504 | A1 | 11/2017 | Liu | |
| 2017/0325506 | A1 | 11/2017 | Batista | |
| 2017/0340003 | A1* | 11/2017 | Batista | A24B 15/167 |
| 2017/0340014 | A1* | 11/2017 | Batista | F22B 1/284 |
| 2017/0367406 | A1 | 12/2017 | Schuler et al. | |
| 2018/0007971 | A1 | 1/2018 | Plojoux et al. | |
| 2018/0020728 | A1 | 1/2018 | Alarcon et al. | |
| 2018/0020729 | A1 | 1/2018 | Alarcon et al. | |
| 2018/0027878 | A1 | 2/2018 | Dendy et al. | |
| 2018/0042306 | A1 | 2/2018 | Atkins et al. | |
| 2018/0043114 | A1 | 2/2018 | Bowen et al. | |
| 2018/0064169 | A1 | 3/2018 | Biel et al. | |
| 2018/0070641 | A1* | 3/2018 | Batista | A61M 15/06 |
| 2018/0070648 | A1 | 3/2018 | Monsees et al. | |
| 2018/0077967 | A1 | 3/2018 | Hatton et al. | |
| 2018/0103685 | A1 | 4/2018 | Yener | |
| 2018/0140014 | A1 | 5/2018 | Yu et al. | |
| 2018/0153208 | A1 | 6/2018 | Schaller et al. | |
| 2018/0160735 | A1 | 6/2018 | Borkovec et al. | |
| 2018/0177231 | A1 | 6/2018 | Woodbine et al. | |
| 2018/0184722 | A1 | 7/2018 | Murison et al. | |
| 2018/0296777 | A1 | 10/2018 | Terry et al. | |
| 2018/0360129 | A1 | 12/2018 | Bowen et al. | |
| 2018/0360130 | A1 | 12/2018 | Bowen et al. | |
| 2018/0368481 | A1 | 12/2018 | Verleur et al. | |
| 2019/0037921 | A1 | 2/2019 | Kennedy et al. | |
| 2019/0069599 | A1 | 3/2019 | Monsees et al. | |
| 2019/0069605 | A1 | 3/2019 | Verleur et al. | |
| 2019/0082740 | A1 | 3/2019 | Verleur et al. | |
| 2019/0104767 | A1 | 4/2019 | Hatton et al. | |
| 2019/0124982 | A1 | 5/2019 | Atkins et al. | |
| 2019/0158938 | A1 | 5/2019 | Bowen et al. | |
| 2019/0166909 | A1 | 6/2019 | Reevell | |
| 2020/0000143 | A1 | 1/2020 | Anderson et al. | |
| 2020/0000146 | A1 | 1/2020 | Anderson et al. | |
| 2020/0120991 | A1 | 4/2020 | Hatton et al. | |
| 2021/0186104 | A1* | 6/2021 | Mironov | A24F 40/57 |

FOREIGN PATENT DOCUMENTS

| | | | | |
|---|---|---|---|---|
| CN | 101862038 | A | 10/2010 | |
| CN | 203416810 | U | 2/2014 | |
| CN | 204273244 | U | 4/2015 | |
| CN | 204275207 | U | 4/2015 | |
| CN | 105473012 | A | 4/2016 | |
| CN | 105764366 | A | 7/2016 | |
| CN | 106102811 | A | 11/2016 | |
| CN | 105476069 | B | 6/2019 | |
| EP | 0503767 | B1 | 5/1995 | |
| EP | 2967149 | B1 | 8/2018 | |
| EP | 3097800 | B1 | 10/2018 | |
| EP | 3078281 | B1 | 1/2019 | |
| EP | 3065581 | B1 | 3/2019 | |
| EP | 3248483 | B1 | 9/2019 | |
| EP | 3326473 | B1 | 11/2020 | |
| EP | 3456214 | B1 | 11/2020 | |
| JP | 2012005412 | A | 1/2012 | |
| KR | 101994297 | B1 | 6/2019 | |
| KR | 20190078647 | A | 7/2019 | |
| TW | 201815301 | A | 5/2018 | |
| WO | WO-2011109849 | A1 | 9/2011 | |
| WO | WO-2014095701 | A1 | 6/2014 | |
| WO | WO-2014110750 | A1 | 7/2014 | |
| WO | WO-2015021646 | A1 | 2/2015 | |
| WO | WO-2015021651 | A1 | 2/2015 | |
| WO | WO-2015054862 | A1 | 4/2015 | |
| WO | WO-2015058341 | A1 | 4/2015 | |
| WO | WO-2015058367 | A1 | 4/2015 | |
| WO | WO-2015107551 | A2 | 7/2015 | |
| WO | WO-2015148649 | A2 | 10/2015 | |
| WO | WO-2015169127 | A1 | 11/2015 | |
| WO | WO-2015190810 | A1 | 12/2015 | |
| WO | WO-2016008067 | A1 | 1/2016 | |
| WO | WO-2016019550 | A1 | 2/2016 | |
| WO | WO-2016070553 | A1 | 5/2016 | |
| WO | WO-2016076178 | A1 | 5/2016 | |
| WO | WO-2016108694 | A1 | 7/2016 | |
| WO | WO-2016118005 | A1 | 7/2016 | |
| WO | WO-2016154900 | A1 | 10/2016 | |
| WO | WO-2016165063 | A1 | 10/2016 | |
| WO | WO-2016193743 | A1 | 12/2016 | |
| WO | WO-2016207357 | A1 | 12/2016 | |
| WO | WO-2017001352 | A2 | 1/2017 | |
| WO | WO-2017020290 | A1 | 2/2017 | |
| WO | WO-2017054424 | A1 | 4/2017 | |
| WO | WO-2017064323 | A1 | 4/2017 | |
| WO | WO-2017067326 | A1 | 4/2017 | |
| WO | WO-2017075827 | A1 | 5/2017 | |
| WO | WO-2017082728 | A1 | 5/2017 | |
| WO | WO-2017084920 | A2 | 5/2017 | |
| WO | WO-2017085240 | A1 | 5/2017 | |
| WO | WO-2017102969 | A1 | 6/2017 | |
| WO | WO-2017109868 | A1 | 6/2017 | |
| WO | WO-2017118138 | A1 | 7/2017 | |
| WO | WO-2017121546 | A1 | 7/2017 | |
| WO | WO-2017122196 | A1 | 7/2017 | |
| WO | WO-2017137510 | A1 | 8/2017 | |
| WO | WO-2017185051 | A1 | 10/2017 | |
| WO | WO-2017207418 | A1 * | 12/2017 | A24B 15/167 |
| WO | WO-2018048813 | A1 | 3/2018 | |
| WO | WO-2018211035 | A1 * | 11/2018 | A24F 40/42 |
| WO | WO-2019011937 | A1 * | 1/2019 | A24B 15/167 |
| WO | WO-2019048211 | A1 | 3/2019 | |
| WO | WO-2019104227 | A1 | 5/2019 | |
| WO | WO-2019122866 | A1 * | 6/2019 | A24F 40/40 |
| WO | WO-2019173923 | A1 | 9/2019 | |
| WO | WO-2020006305 | A1 | 1/2020 | |
| WO | WO-2020023547 | A1 | 1/2020 | |

* cited by examiner

CARTRIDGES WITH VAPORIZABLE MATERIAL INCLUDING AT LEAST ONE IONIC COMPONENT

CROSS-REFERENCE TO RELATED APPLICATIONS

This application claims priority to U.S. Provisional Patent Application No. 62/755,929 filed on Nov. 5, 2018, and entitled "Cartridges For Vaporizer Devices," the disclosure of which is incorporated herein by reference in its entirety.

TECHNICAL FIELD

The subject matter described herein relates to vaporizer devices, including vaporizer cartridges.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizer devices are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer device can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporizer device.

Vaporizer devices can be controlled by one or more controllers, electronic circuits (for example, sensors, heating elements), and/or the like on the vaporizer device. Vaporizer devices can also wirelessly communicate with an external controller for example, a computing device such as a smartphone).

A vaporizer device typically uses an atomizer that heats the vaporizable material and delivers an inhalable aerosol instead of smoke. The atomizer can include a wicking element that conveys an amount of a vaporizable material (along its length) to a part of the atomizer that includes a heating element. However, the temperature of the heating element can be difficult to control, resulting in hot spots. Absent rigorous temperature control, the inhalable vapor may contain undesirable chemical components, such as carbonyl containing compounds, which result from heating the vaporizable material at too high of a temperature. Alternatively, or additionally, the placement of the heating element can be non-optimal for thermal transport (e.g., insufficient contact with the wicking element).

Accordingly, vaporizer devices and/or vaporizer cartridges that address one or more of these issues are desired.

SUMMARY

Aspects of the current subject matter relate to vaporizer devices and to cartridges for use in a vaporizer device.

In some variations, one or more of the following features may optionally be included in any feasible combination.

In one exemplary embodiment, a cartridge is provided and includes a reservoir being configured to contain a liquid vaporizable material, an airflow tube that extends though the reservoir and defines an airflow passageway therethrough, and first and second electrodes. The liquid vaporizable material includes at least one ionic component. The airflow tube includes a wicking element that is in fluid communication with the reservoir. The wicking element is configured to substantially draw at least a portion of the liquid vaporizable material from the reservoir into the airflow passageway. The first and second electrodes are positioned substantially on or adjacent to opposite surfaces of the wicking element, in which the liquid vaporizable material received within the wicking element is substantially vaporized in response to generation of a potential difference between the first and second electrodes.

The first electrode and the second electrode can each have a variety of configurations. For example, in some embodiments, at least the first electrode can be substantially permeable to the vaporized material. In some embodiments, at least the second electrode can be substantially permeable to airflow passing through the airflow passageway. In some embodiments, the first electrode can be a first metal plate and the second electrode can be a second metal plate.

In some embodiments, the first electrode and the second electrode can each be configured to be in electrical communication with a power source. In one embodiment, activation of the power source can result in ohmic heating and vaporization of at least a portion of the liquid vaporizable material received within the wicking element. In another embodiments, activation of the power source can result in capacitive heating and vaporization of at least a portion of the liquid vaporizable material received within the wicking element.

In some embodiments, the generated potential difference can be configured to substantially cease in response to a resistance between the first electrode and the second electrode exceeding a predetermined threshold resistance.

The airflow tube can have a variety of configurations. In some embodiments, the airflow tube can include a porous element that is in fluid communication with the reservoir. The porous element can be configured to recycle a portion of the liquid vaporizable material within the airflow passageway back into the reservoir.

In another exemplary embodiment, a cartridge is provided and includes a reservoir being configured to contain a liquid vaporizable material, an airflow tube that extends though the reservoir and defines an airflow passageway therethrough, and a conduit in fluid communication with the reservoir and the airflow passageway such that at least a portion of the liquid vaporizable material can be received therethrough. The liquid vaporizable material includes at least one ionic component. The conduit is bounded by opposed sidewalls defining first and second electrodes, in which the liquid vaporizable material received within the airflow passageway is substantially vaporized in response to generation of a potential difference between the first and second electrodes.

The first electrode and the second electrode can each have a variety of configurations. For example, in some embodiments, at least the first electrode can be substantially permeable to the vaporized material. In some embodiments, at least the second electrode can be substantially permeable to airflow passing through the airflow passageway.

In some embodiments, the first electrode and the second electrode can each be configured to be in electrical communication with a power source. In one embodiment, activation of the power source can result in ohmic heating and vaporization of at least a portion of the liquid vaporizable material received within the conduit. In another embodiment, activation of the power source can result in capacitive heating and vaporization of at least a portion of the liquid vaporizable material received within the conduit.

In some embodiments, the generated potential difference can be configured to substantially cease in response to a resistance between the first electrode and the second electrode exceeding a predetermined threshold resistance.

The airflow tube can have variety of configurations. For example, in some embodiments, the airflow tube can include a porous element that is in fluid communication with the reservoir. The porous element can be configured to recycle a portion of the liquid vaporizable material within the airflow passageway back into the reservoir.

In another exemplary embodiment, a vaporizer device is provided and includes a vaporizer body and a cartridge that is selectively coupled to and removable from the vaporizer body. The cartridge includes a reservoir being configured to contain a liquid vaporizable material, an airflow tube that extends though the reservoir and defines an airflow passageway therethrough, and first and second electrodes. The liquid vaporizable material includes at least one ionic component. The airflow tube includes a wicking element that is in fluid communication with the reservoir. The wicking element is configured to substantially draw at least a portion of the liquid vaporizable material from the reservoir into the airflow passageway. The first and second electrodes are positioned substantially on or adjacent to opposite surfaces of the wicking element, in which the liquid vaporizable material received within the wicking element is substantially vaporized in response to generation of a potential difference between the first and second electrodes.

The vaporizer body can have a variety of configurations. For example, in some embodiments, the vaporizer body can include a power source. The power source can be configured to be in electrical communication with the first electrode and the second electrode. In some embodiments, activation of the power source can result in ohmic heating and vaporization of at least a portion of the liquid vaporizable material received within the wicking element. In other embodiments, activation of the power source can result in capacitive heating and vaporization of at least a portion of the liquid vaporizable material received within the wicking element.

In some embodiments, the generated potential difference can be configured to substantially cease in response to a resistance between the first electrode and the second electrode exceeding a predetermined threshold resistance.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a cartridge (for example, a part of the vaporizer device that contains the vaporizable material in a reservoir or other container) which can be refillable when empty, or disposable such that a new cartridge containing additional vaporizable material of a same or different type can be used). A vaporizer device can be a cartridge-using vaporizer device, a cartridge-less vaporizer device, or a multi-use vaporizer device capable of use with or without a cartridge. For example, a vaporizer device can include a heating chamber (for example, an oven or other region in which material is heated by a heating element) configured to receive a vaporizable material directly into the heating chamber, and/or a reservoir or the like for containing the vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself). The liquid vaporizable material can be capable of being completely vaporized. Alternatively, at least a portion of the liquid vaporizable material can remain after all of the material suitable for inhalation has been vaporized.

Figure 1A:
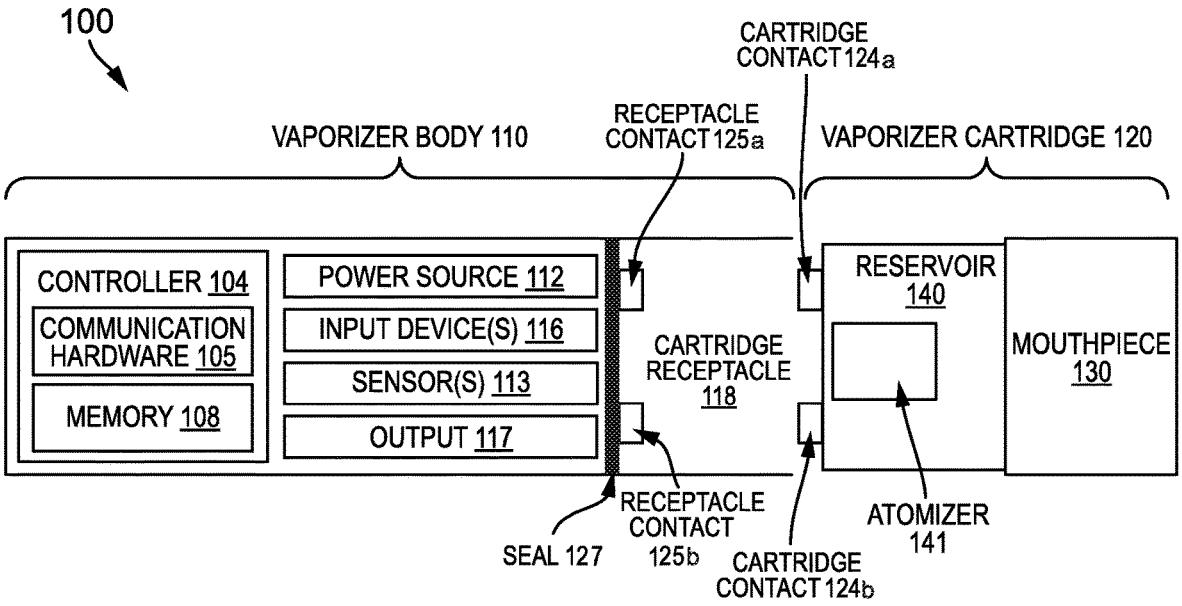
FIG. 1A is a block diagram of a vaporizer device.

Referring to the block diagram of FIG. 1A, a vaporizer device 100 can include a power source 112 (for example, a battery, which can be a rechargeable battery), and a controller 104 (for example, a processor, circuitry, etc. capable of executing logic) for controlling delivery of heat to an atomizer 141 to cause a vaporizable material 102 to be converted from a condensed form (such as a liquid, a solution, a suspension, a part of an at least partially unprocessed plant material, etc.) to the gas phase. The controller 104 can be part of one or more printed circuit boards (PCBs)s consistent with certain implementations of the current subject matter.

After conversion of the vaporizable material 102 to the gas phase, at least some of the vaporizable material 102 in the gas phase can condense to form particulate matter in at least a partial local equilibrium with a portion of the vaporizable material 102 that remains in the gas phase. The vaporizable material 102 in the gas phase as well as the condensed phase are part of an aerosol, which can form some or all of an inhalable dose provided by the vaporizer device 100 during a user's puff or draw on the vaporizer device 100. It should be appreciated that the interplay between the gas phase and condensed phase in an aerosol generated by a vaporizer device 100 can be complex and dynamic, due to factors such as ambient temperature, relative humidity, chemistry, flow conditions in airflow paths (both inside the vaporizer device and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer 141 can include a wicking element (i.e., a wick) configured to convey an amount of the vaporizable material 102 to a part of the atomizer 141 that includes a heating element (not shown in FIG. 1A).

For example, the wicking element can be configured to draw the vaporizable material 102 from a reservoir 140 configured to contain the vaporizable material 102, such that the vaporizable material 102 can be vaporized by heat delivered from a heating element. The wicking element can also optionally allow air to enter the reservoir 140 and replace the volume of vaporizable material 102 removed. In some implementations of the current subject matter, capillary action can pull vaporizable material 102 into the wick for vaporization by the heating element, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the atomizer 141 can include a heating element which includes a resistive coil or other heating element wrapped around, positioned within, integrated into a bulk shape of, pressed into thermal contact with, or otherwise arranged to deliver heat to a wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer assembly configurations are also possible.

The heating element can be activated in association with a user puffing (i.e., drawing, inhaling, etc.) on a mouthpiece 130 of the vaporizer device 100 to cause air to flow from an air inlet, along an airflow path that passes the atomizer 141 (i.e., wicking element and heating element). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element can be activated via the controller 104, which can optionally be a part of a vaporizer body 110 as discussed herein, causing current to pass from the power source 112 through a circuit including the resistive heating element, which is optionally part of a vaporizer cartridge 120 as discussed herein. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element can be caused by automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of a resistive heating element of the vaporizer device 100 can depend on a number of factors, including an amount of electrical power delivered to the resistive heating element and/or a duty cycle at which the electrical power is delivered, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (i.e., air moving across the heating element or the atomizer 141 as a whole when a user inhales on the vaporizer device 100). As noted herein, to reliably activate the heating element or heat the heating element to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element can be activated in association with a user's puff, for example by automatic detection of the puff, or by the sensor 113 detecting a change (such as a pressure change) in the airflow path.

The sensor 113 can be positioned on or coupled to (i.e., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer device, the seal 127 can also separate parts of one or more electrical connections between the vaporizer body 110 and the vaporizer cartridge 120. Such arrangements of the seal 127 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and a heating element. Alternatively, one or both of the wicking element and the heating element can be part of the vaporizer body 110. In implementations in which any part of the atomizer 141 (i.e., heating element and/or wicking element) is part of the vaporizer body 110, the vaporizer device 100 can be configured to supply vaporizable material 102 from the reservoir 140 in the vaporizer cartridge 120 to the part(s) of the atomizer 141 included in the vaporizer body 110.

In an embodiment of the vaporizer device 100 in which the power source 112 is part of the vaporizer body 110, and a heating element is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element (for example, a heating element within the atomizer 141). These features can include one or more contacts (referred to herein as cartridge contacts 124*a* and 124*b*) on a bottom surface of the vaporizer cartridge 120 and at least two contacts (referred to herein as receptacle contacts 125*a* and 125*b*) disposed near a base of the cartridge receptacle 118 of the vaporizer device 100 such that the cartridge contacts 124*a* and 124*b* and the receptacle contacts 125*a* and 125*b* make electrical connections when the vaporizer cartridge 120 is inserted into and coupled with the cartridge receptacle 118. The circuit completed by these electrical connections can allow delivery of electrical current to a heating element and can further be used for additional functions, such as measuring a resistance of the heating element for use in determining and/or controlling a temperature of the heating element based on a thermal coefficient of resistivity of the heating element.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

For example, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
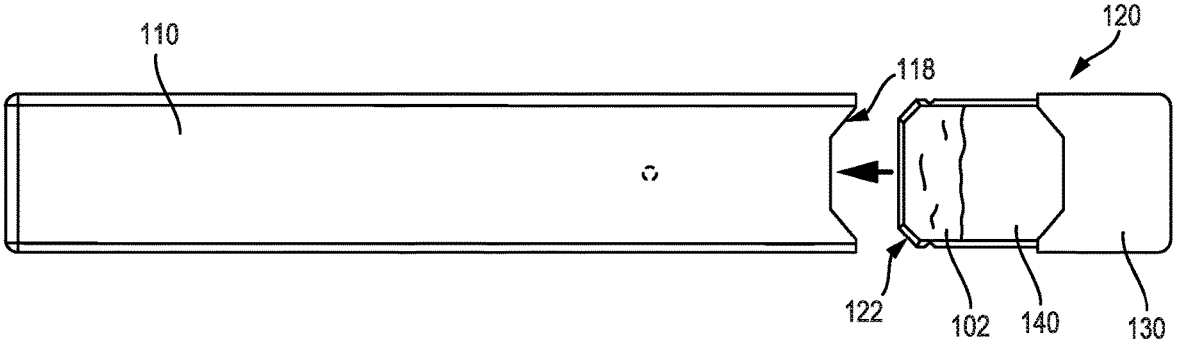
FIG. 1B is a top view of an embodiment of a vaporizer device, showing a vaporizer cartridge separated from a vaporizer device body.
Figure 1C:
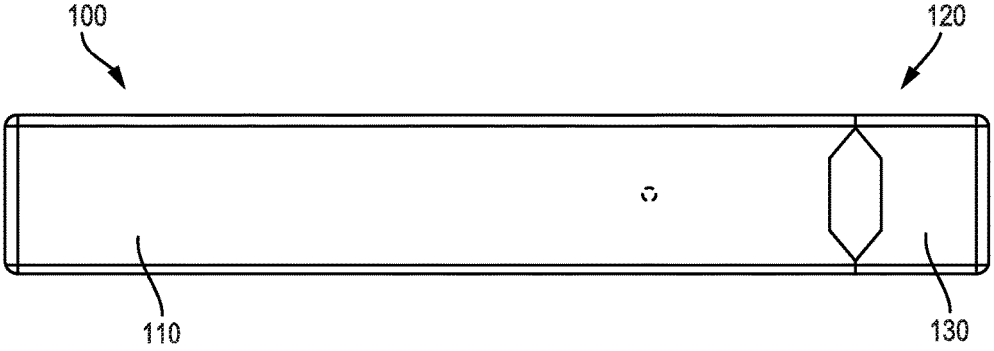
FIG. 1C is a top view of the vaporizer device of FIG. 1B, showing the vaporizer cartridge coupled to the vaporizer device body.
Figure 1D:
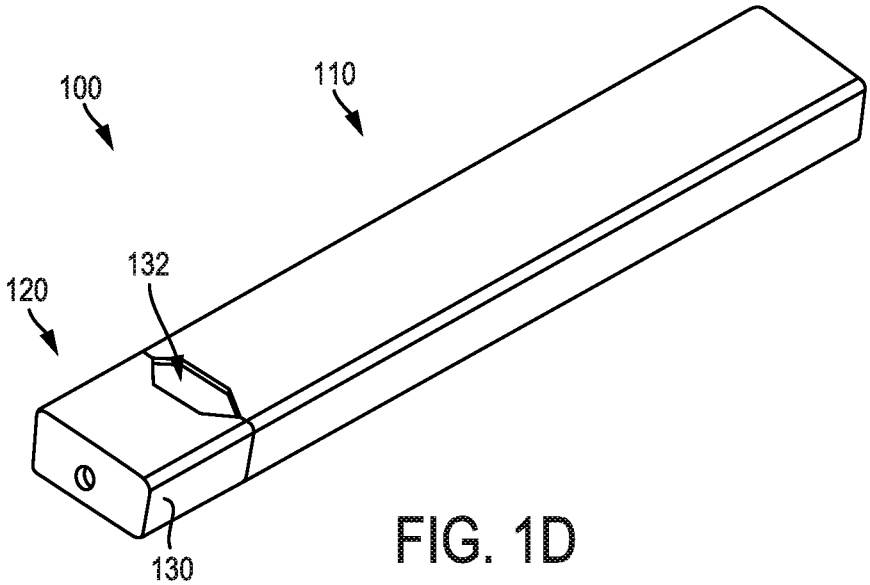
FIG. 1D is a perspective view of the vaporizer device of FIG. 1C.

FIGS. 1B-1D illustrate an embodiment of the vaporizer body 110 having a cartridge receptacle 118 into which the vaporizer cartridge 120 can be releasably inserted. FIGS. 1B and 1C show top views of the vaporizer device 100 illustrating the vaporizer cartridge 120 being positioned for insertion and inserted, respectively, into the vaporizer body 110. FIG. 1D illustrates the reservoir 140 of the vaporizer cartridge 120 being formed in whole or in part from translucent material such that a level of the vaporizable material 102 is visible from a window 132 (e.g., translucent material) along the vaporizer cartridge 120. The vaporizer cartridge 120 can be configured such that the window 132 remains visible when insertably received by the vaporizer cartridge receptacle 118 of the vaporizer body 110. For example, in one exemplary configuration, the window 132 can be disposed between a bottom edge of the mouthpiece 130 and a top edge of the vaporizer body 110 when the vaporizer cartridge 120 is coupled with the cartridge receptacle 118.

Figure 1E:
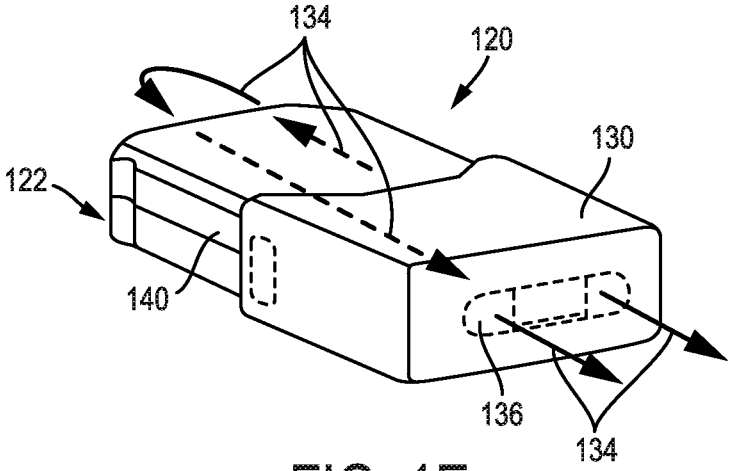
FIG. 1E is a perspective view of the vaporizer cartridge of FIG. 1B.

FIG. 1E illustrates an example airflow path 134 created during a puff by a user on the vaporizer device 100. The airflow path 134 can direct air to a vaporization chamber 150 (see FIG. 1F) contained in a wick housing where the air is combined with inhalable aerosol for delivery to a user via a mouthpiece 130, which can also be part of the vaporizer cartridge 120. For example, when a user puffs on the vaporizer device 100 device 100, air can pass between an outer surface of the vaporizer cartridge 120 (for example, window 132 shown in FIG. 1D) and an inner surface of the cartridge receptacle 118 on the vaporizer body 110. Air can then be drawn into the insertable end 122 of the vaporizer cartridge 120, through the vaporization chamber 150 that includes or contains the heating element and wick, and out through an outlet 136 of the mouthpiece 130 for delivery of the inhalable aerosol to a user.

As shown in FIG. 1E, this configuration causes air to flow down around the insertable end 122 of the vaporizer cartridge 120 into the cartridge receptacle 118 and then flow back in the opposite direction after passing around the insertable end 122 (e.g., an end opposite of the end including the mouthpiece 130) of the vaporizer cartridge 120 as it enters into the cartridge body toward the vaporization chamber 150. The airflow path 134 then travels through the interior of the vaporizer cartridge 120, for example via one or more tubes or internal channels (such as cannula 128 shown in FIG. 1F) and through one or more outlets (such as outlet 136) formed in the mouthpiece 130. The mouthpiece 130 can be a separable component of the vaporizer cartridge 120 or can be integrally formed with other component(s) of the vaporizer cartridge 120 (for example, formed as a unitary structure with the reservoir 140 and/or the like).

Figure 1F:
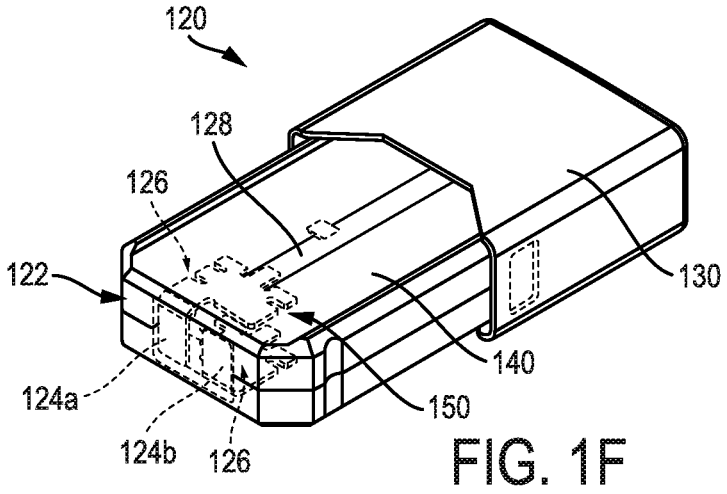
FIG. 1F is another perspective view of the vaporizer cartridge of FIG. 1E.

FIG. 1F shows additional features that can be included in the vaporizer cartridge 120 consistent with implementations of the current subject matter. For example, the vaporizer cartridge 120 can include a plurality of cartridge contacts (such as cartridge contacts 124*a*, 124*b*) disposed on the insertable end 122. The cartridge contacts 124*a*, 124*b* can optionally each be part of a single piece of metal that forms a conductive structure (such as conductive structure 126) connected to one of two ends of a resistive heating element. The conductive structure can optionally form opposing sides of a heating chamber and can act as heat shields and/or heat sinks to reduce transmission of heat to outer walls of the vaporizer cartridge 120. FIG. 1F also shows the cannula 128 within the vaporizer cartridge 120 that defines part of the airflow path 134 between the heating chamber formed between the conductive structure 126 and the mouthpiece 130.

As mentioned above, existing vaporizer devices can include an atomizer that includes a separate heating element to ultimately vaporize the vaporizable material into a vaporized material. The heat generated by the heating element of such existing vaporizer devices, however, can be too great, resulting in not only vaporization but potentially chemical breakdown of the vaporizable material. Alternatively or additionally, the placement of the heating element can be non-optimal for thermal transport (e.g., insufficient contact with the wicking element), which can result in hot spots. Further, the thermal mass of the heating element may also be problematic if not properly tailored. That is, the heating element may require significant time to generate sufficient heat for use, delaying the onset of vaporization of the vaporizable material when the user puffs on a mouthpiece of the device. Conversely, a high thermal mass can result in slow cooling of the heating element, resulting in continued vaporization of the vaporizable material after cessation of the puffing, thereby wasting vaporizable material. Various features and devices are described below that improve upon or overcome these issues.

The vaporizer cartridges described herein are designed to utilize the resistance of the vaporizable material itself, rather than the resistance of a heating element, to provide the heating needed to vaporize the vaporizable material. That is, the vaporizable material itself can serve as the heating element, thereby obviating the need for a separate heating element as well as complex temperature controls. Further, as discussed in more detail below, the wicking element can also be eliminated.

The cartridges generally include a reservoir, an airflow tube, a first electrode, and a second electrode. The airflow tube extends though the reservoir and defines an airflow passageway therethrough. The reservoir is configured to contain a liquid vaporizable material that includes at least one ionic component such that the liquid vaporizable material can function as a conductor of electric current. The first and second electrodes are spaced a distance apart from each other such that at least a portion of the liquid vaporizable material can be received therebetween, and thus, received within the airflow passageway, from the reservoir. In use, at least a portion of the liquid vaporizable material received within the airflow passageway is substantially vaporized in response to generation of a potential difference between the first electrode and the second electrode.

The first electrode and/or second electrode can be configured to be substantially permeable to gas (e.g., air and/or vaporized material). For example, in one embodiment, the first electrode and/or the second electrode can include at least one vent that extends therethrough. The at least one vent can be configured to allow at least a portion of the vaporized material to pass therethrough and into the airflow passageway. Alternatively, or in addition, the at least one vent can be configured to allow at least a portion of the airflow to pass therethrough, and ultimately into the airflow passageway to mix with the vaporized material. The at least one vent can have a variety of configurations (e.g., dimensions, geometry, etc.). In instances in which the first electrode and/or the second electrode include more than one vent, the vents can have the same size, or alternatively, the size of at least a portion of the vents can vary relative to each other.

In one embodiment, the at least one vent of the second electrode can be configured to substantially inhibit vaporized material from passing therethrough. As such, the second electrode can aid in directing the vaporized material to flow through the first electrode and into the airflow passageway, and ultimately out of the airflow tube for inhalation by the user.

In one embodiment, the first and second electrodes define opposing sidewalls of a conduit that is in fluid communication with the reservoir and the airflow passageway such that at least a portion of the liquid vaporizable material can be received therethrough.

In another embodiment, the airflow tube can include a wicking element. The wicking element extends a width from a first surface to a second opposing surface and is positioned between the first and second electrodes. The first electrode can be positioned substantially on or adjacent to the first surface of the wicking element and the second electrode can be positioned substantially on or adjacent to a second opposing side of the wicking element. In such embodiments, the wicking element is in fluid communication with the reservoir. The wicking element is configured to substantially draw at least a portion of the liquid vaporizable material from the reservoir into the airflow passageway, and thus between the first electrode and the second electrode.

The wicking element can be formed of any suitable material that can substantially draw the liquid vaporizable material into the airflow passageway of the airflow tube. As such, the wicking element is substantially porous. Further, the wicking element can be formed of a substantially electrically insulating material. Non-limiting examples of suitable materials for the wicking element can include of one or more ceramic materials, one or more cottons, or one or more polymers. Such drawing of the liquid vaporizable material into the airflow tube can be due, at least in part, to capillary action provided by the porous wicking element, which pulls the vaporizable material along the wick in the direction of the airflow tube.

In certain embodiments, the material and/or the geometry of the first and second electrodes are configured to possess predetermined electrical properties (e.g., electrical conductivity, electrical resistivity, capacitance, etc.). The first and second electrodes can be formed of any suitable electrically conductive material. Non-limiting examples of suitable electrically conductive materials include metals, alloys, ceramics, polymers, and composites thereof, and the like. In one embodiment, the first and second electrodes are formed of metal.

The first and second electrodes can have a variety of geometric configurations. In one embodiment, the electrodes can take the form of substantially flat plates arranged approximately parallel to one another at a predefined offset distance. The predefined offset distance is configured to receive at least a portion of the liquid vaporizable material. In one embodiment, the first electrode and/or the second electrode is a substantially flat metal plate. In embodiments where the airflow tube includes a wicking element, the predefined offset distance can be dimensioned to receive the wicking element. For example, the offset distance may be substantially equal to or greater than a width of the wicking element (e.g., the width of the wicking element extending from the first surface to the second surface of the wicking element).

The first electrode and the second electrode are each configured to be in electrical communication with a power source. In some embodiments, the power source may be configured to establish a potential difference across the electrodes when the power source is activated. In one embodiment, the power source is configured to substantially establish a DC potential difference. In another embodiment, the power source is configured to substantially establish an AC potential difference.

The liquid vaporizable material is configured to possess an electrical resistance suitable for ohmic heating and/or capacitive heating sufficient to vaporize the liquid vaporizable material. As discussed above, the liquid vaporizable material includes at least one iconic component. The concentration of, and/or the type of, the ionic component(s) can be tailored to vary the electrical resistance of the liquid vaporizable material. Additionally, the tailored concentration can be used as a way to prevent alternative formulations (e.g., not approved by manufacturer) from being used with the vaporizer device (e.g., if a user were to refill the cartridges with such an alternative formulation). That is, the type and/or the concentration of the iconic component(s) can function as an identification marker such that the power source will not be activated until the device detects such identification marker. For example, the type and/or concentration of the ionic component(s) can be tailored to respond only to potential differences at certain frequencies.

The presence of the at least one ionic component influences the electrical conductivity of the liquid vaporizable material. In embodiments wherein the power source applies a DC potential difference, a DC current is conducted between the first and second electrodes by the liquid vaporizable material. When the electrical resistance of the vaporizable material is sufficiently high, the DC current will result in ohmic heating, and subsequent vaporization of, the liquid vaporizable material through which it travels.

Alternatively, when the power source applies an AC potential difference, an AC current is conducted between the first electrode and the second electrode by the liquid vaporizable material. When the electrical resistance of the liquid vaporizable material is sufficiently high the AC current will result in capacitive heating, and subsequent vaporization of, the liquid vaporizable material through which it travels.

Advantageously, the power source is configured such that current is not conducted between the first and second electrodes when less than a threshold volume of the liquid vaporizable material is present within the conduit, or the wicking element, if present. For example, the circuit containing the power source can include an element configured to measure an electrical resistance of the circuit. Thus, when the liquid vaporizable material is substantially depleted from the reservoir and the resistance of the circuit significantly increases, the power source can detect the resistance increase and deactivate in response to the detection. That is, the generated potential difference can be configured to substantially cease in response to the resistance between the first electrode and the second electrode exceeding a predetermined threshold resistance. The predetermined threshold resistance is dependent on the volume of the liquid vaporizable material present between the first electrode and the second electrode (e.g., within the conduit or within the wicking element, if present). Thus, the quantity of the liquid vaporizable material present between the first electrode and the second electrode can function as a switch. For example, the switch is open when a below threshold volume of the liquid vaporizable material is present between the first electrode and the second electrode. As a result, the power supply cannot be activated when the switch is open. Thus, the cartridges can function as a self-regulating system.

Further, this switch-like functionality provides numerous additional advantages. In one aspect, it can function as a safety measure preventing overheating and possible burning of the cartridge when the liquid vaporizable material is below a predetermined level (e.g., a threshold volume). In another aspect, detection of the resistance being greater than a predetermined threshold resistance can be employed as a trigger to generate a cue (e.g., audio or visual) to the user that the cartridge is substantially depleted of liquid vaporizable material and needs to be replaced.

The cartridge can include, or be in communication with, a detector to detect the presence of the at least one ionic component and/or concentration of the liquid vaporizable material. If the detector does not detect the presence and/or concentration of the at least one iconic component, the power source can be inhibited from activation. Further, if the detector does detect the presence and/or concentration of the at least one iconic component, the power source can be activated. This detection functionality can ensure that the vaporizer device operates only with a cartridge containing the liquid vaporizable material and not alternative liquid vaporizable materials (e.g., non-original formulations). Alternative liquid vaporizable materials may possess different chemical and/or electrical properties that are not compatible with the vaporizer device or may be potential harmful when vaporized and then inhaled by a user.

Further, the airflow tube can include a porous element that is in fluid communication with the reservoir. The porous element is configured to recycle a portion of the liquid vaporizable material within the airflow passageway back into the reservoir. For example, a porous element may be positioned between the second electrode and an end of the airflow tube, and configured to absorb at least a portion of the vaporized material that may become trapped within the airflow passageway (e.g., between a bottom wall of the airflow tube and the second electrode). In this way, the absorbed vaporized material can condense back into liquid vaporizable material as air passes into the airflow passageway and across the porous element. As a result, the condensed liquid vaporizable material can then be recycled back into the reservoir for reuse. This recycling can be accomplished, for example, through capillary action of the porous material in response to a pressure differential that can be created as the liquid vaporizable material within the reservoir is drawn into the conduit, or the wicking element if present, and vaporized into a vaporized material) for reuse.

Figure 2:
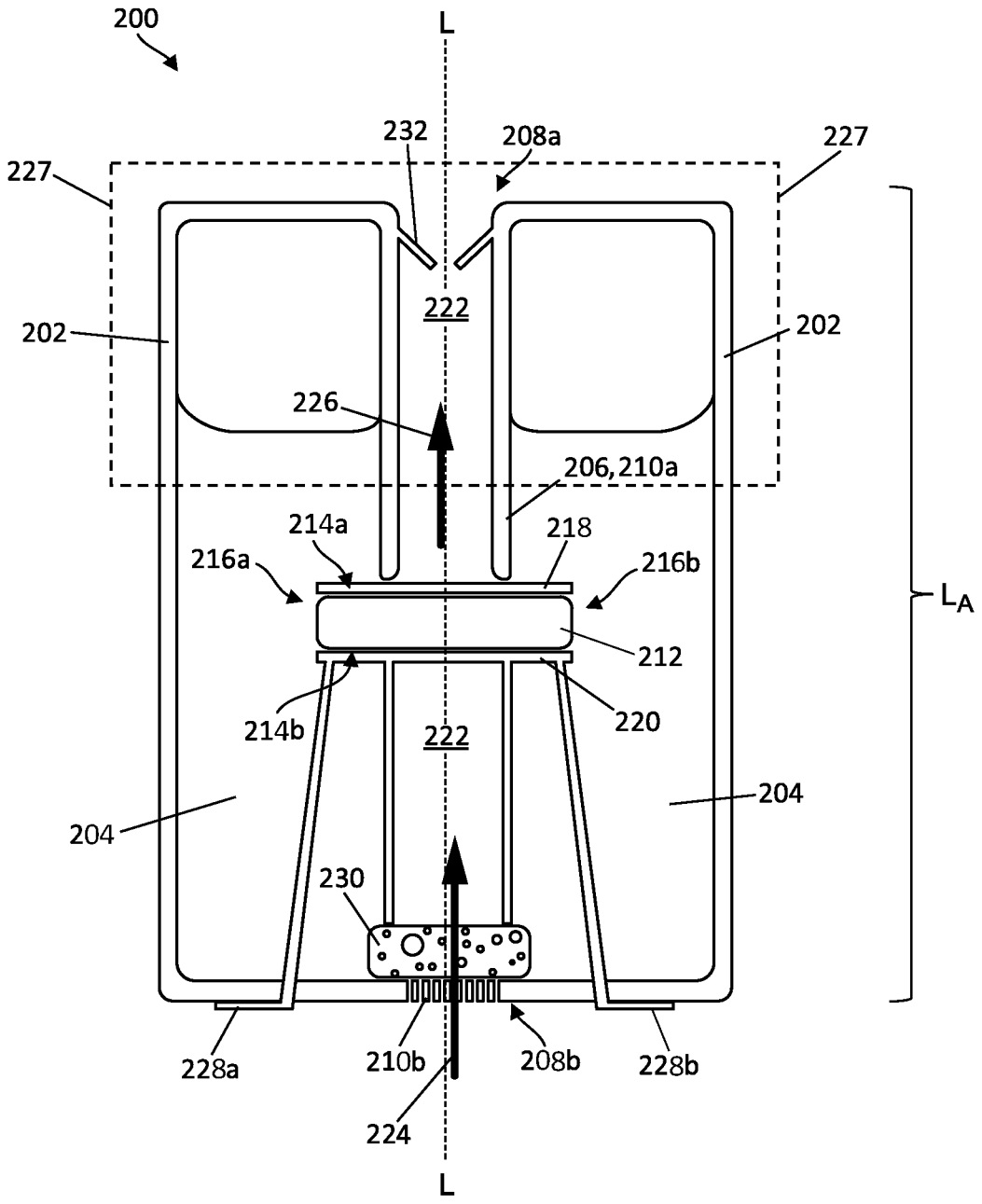
FIG. 2 illustrates a schematic cross-sectional view of another embodiment of a vaporizer cartridge.

FIG. 2 illustrates an exemplary vaporizer cartridge 200 that can be selectively coupled to and removable from a vaporizer body, such as vaporizer body 110 shown in FIGS. 1A-1D. More specifically, the cartridge 200 includes a reservoir 202 configured to contain a liquid vaporizable material 204, an airflow tube 206 extending through the reservoir 202, a wicking element 212 positioned within the airflow tube 206, and first and second electrodes 218, 220 positioned substantially on or adjacent to opposite surfaces 214*a*, 214*b* of the wicking element 212. As discussed above, the liquid vaporizable material 204 includes at least one ionic component. For purposes of simplicity, certain components of the cartridge 200 are not illustrated.

While the reservoir 202 can have a variety of shapes and sizes, the reservoir 202, as shown in FIG. 2, is substantially rectangular in shape. Other shapes and sizes of the reservoir 202 are contemplated herein.

While the airflow tube 206 is shown to be approximately centered with respect to a longitudinal axis (L) extending through a centroid of the reservoir 202, such position is not required. As such, other locations of the airflow tube 206 within the reservoir 202 are also contemplated herein. Further, other airflow configurations through the reservoir 202 are also contemplated herein.

The airflow tube 206 can have a variety of configurations. For example, as shown in FIG. 2, the airflow tube 206 extends a length (LA) from a first end 208*a* to a second end 208*b* and is defined by a curved sidewall 210*a* and a bottom wall 210*b*. Further, the airflow tube 206 defines an airflow passageway 222 that extends therethrough. The airflow passageway 222 is configured to direct air, illustrated as arrow 224, through the airflow tube 206 so that the air 224 will mix with the vaporized material to form an aerosol, illustrated as arrow 226. The airflow passageway 222 further directs the aerosol 226 through the first end 208*a* (e.g., an outlet) of the airflow tube 206, and thus into a mouthpiece 227 that is coupled to the vaporizer cartridge 200, for inhalation by a user. While a mouthpiece 227 is shown in FIG. 2, a person skilled in the art will appreciate that in other embodiments, the mouthpiece 227 can be omitted and the user can directly puff on the cartridge 200 at an outlet (such as the first end 208*a* of the airflow tube 206).

As shown, air 224 enters the airflow tube 206 through the bottom wall 210*b* as a user puffs the mouthpiece of the vaporizer device. As such, the bottom wall 210*b* is configured to allow the air 224 to readily pass therethrough and into the airflow tube 206. While the bottom wall 210*b* can have a variety of configurations, the bottom wall 210*b* is perforated, as shown in FIG. 2. The perforations can be of any suitable size that allows air to pass through the bottom wall 210*b*. In certain embodiments, the size of the perforations can substantially inhibit any liquid vaporizable material 204 and/or aerosol 226 present in the airflow tube 206 to pass through the bottom wall 210*b*. In this manner, undesirable leakage of the liquid vaporizable material 204 and/or aerosol 226 into other portions of the vaporizer cartridge 200 and/or the vaporizer device can be inhibited. The bottom wall 210*b* can include any suitable number of perforations, and therefore the number of perforations is not limited by what is illustrated in the FIG. 2. Alternatively or in addition, the bottom wall 210*b* can be formed of an air permeable material. Thus, the bottom wall 210*b* functions as an air inlet for the airflow tube 206.

As discussed above, the wicking element 212 is configured to substantially draw at least a portion of the liquid vaporizable material 204 from the reservoir 202 into the airflow passageway 222. While the wicking element 212 can have a variety of configurations, the wicking element 212, as shown in FIG. 2, is substantially rectangular. The wicking element 212 extends substantially laterally across the airflow tube 206 (e.g., substantially perpendicular to the length (LA) of the airflow tube 206) such that a first end 216*a* and a second opposing end 216*b* of the wicking element 212 are each positioned within the reservoir 202. As such, the wicking element 212 is in fluid communication with the reservoir 202. Further, the wicking element 212 is fluid permeable and configured to allow at least a portion of the air 224 to pass therethrough, and thus, ultimately mix with the vaporized material.

As shown, the first and second electrodes 218, 220 are positioned substantially on or adjacent to opposite surfaces 214*a*, 214*b* of the wicking element 212. The opposite surfaces 214*a*, 214*b* extend substantially parallel to one another and extend laterally across the airflow tube 206. While the first and second electrodes 218, 220 can have a variety of configurations, the first and second electrodes 218, 220, as shown in FIG. 2, are substantially flat plates, e.g., substantially flat metal plates. While not shown, the first and second electrodes each include at least one vent extending therethrough. As discussed above, the at least one vent extending through at least the first electrode 218 is configured to allow at least a portion of vaporized material to pass therethrough. Further, the at least one vent extending through the second electrode 220 is configured to substantially allow at least a portion of the air 224 to pass therethrough such that the portion of the air 224 can pass through the wicking element 212, as discussed above. Further, the at least one vent of the first electrode 218 is also configured to substantially allow the air 224 to pass therethrough such that the air 224 can ultimately mix with the vaporized material to form aerosol 226 and pass out of the airflow tube 206.

The first and second electrodes 218, 220 are configured for electrical communication to a power source, such as the power source 112 within vaporizer body 110 shown in FIGS. 1A-1D. For example, in some embodiments, the vaporizer cartridge 200 includes two or more cartridge contacts such as, for example, a first cartridge contact 228*a* and a second cartridge contact 228*b*. The two or more cartridge contacts can be configured to couple, for example, with the receptacle contacts 125*a* and 125*b* in order to form one or more electrical connections with the power source 112. The circuit completed by these electrical connections can allow delivery of electrical current to the first electrode 218 and the second electrode 220.

In use, when the power source is activated, a potential difference is created between the first electrode 218 and the second electrode 220. As discussed above, the presence of the at least one ionic component within the liquid vaporizable material 204 allows the liquid vaporizable material 204 to conduct electric current between the first electrode 218 and the second electrode 220. The electrical resistance of the liquid vaporizable material 204 can be tailored to effect heating (ohmic or capacitive heating). In this way, at least a portion of the liquid vaporizable material 204 within the wicking element 212 is vaporized into vaporized material. The vaporized material can then mix with, and be carried out of the airflow tube 206 by, the air 224 passing through the airflow passageway 222 into the mouthpiece 227 for inhalation by a user.

Further, as shown in FIG. 2, the airflow tube 206 includes a porous element 230 that is positioned adjacent to the bottom wall 210*b* of the airflow tube 206. The porous element 230 is in fluid communication with the reservoir 202. While the porous element 230 can have a variety of configurations, the porous element 230, as shown, is substantially rectangular. As discussed above, the porous element 230 can be configured to absorb at least a portion of vaporized material that may become trapped within the airflow passageway 222 (e.g., between the bottom wall 210*b* and the second electrode 220) such that it can be condensed back into liquid vaporizable material 204 as the air 224 passes into the airflow passageway 222 and through the porous element 230, and drawn back into the reservoir 202 for reuse.

The vaporizer cartridge 200 can also include a spit-catch element 232 that is disposed within the airflow tube 206. The spit-catch element 232 can be configured to prevent the ingress of external material (e.g., saliva and/or the like) into airflow passageway 222 including by capturing the external material. While the spit-catch element 232 can be disposed within any portion of the airflow tube 206, the spit-catch element 232 is disposed proximate to the first end 208*a* of the airflow tube 206. The spit-catch element 232 can have a variety of configurations. As shown, the spit-catch element 232 is in the form of a projection extending radially inward from the curved sidewall 210*a* of the airflow tube 206. Other various configurations of suitable spit-catch elements are contemplated herein. It is also contemplated herein that a spit-catch element can be omitted.

Terminology

For purposes of describing and defining the present teachings, it is noted that unless indicated otherwise, the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A cartridge for a vaporizer device, the cartridge comprising:

a reservoir being configured to contain a liquid vaporizable material, the liquid vaporizable material including at least one ionic component;

an airflow tube that extends though the reservoir and defines an airflow passageway therethrough, the airflow tube including a wicking element that is in fluid communication with the reservoir, the wicking element being configured to substantially draw at least a portion of the liquid vaporizable material from the reservoir into the airflow passageway; and a first electrode and a second electrode positioned substantially on or adjacent to opposite surfaces of the wicking element, wherein the liquid vaporizable material received within the wicking element conducts electric current and is substantially vaporized in response to generation of a potential difference between the first and second electrodes.

2. The cartridge of claim 1, wherein the first electrode and the second electrode are each configured to be in electrical communication with a power source, and wherein activation of the power source results in ohmic heating and vaporization of at least a portion of the liquid vaporizable material received within the wicking element.

3. The cartridge of claim 1, wherein the first electrode and the second electrode are each configured to be in electrical communication with a power source, and wherein activation of the power source results in capacitive heating and vaporization of at least a portion of the liquid vaporizable material received within the wicking element.

4. The cartridge of claim 1, wherein the generated potential difference is configured to substantially cease in response to a resistance between the first electrode and the second electrode exceeding a predetermined threshold resistance.

5. The cartridge of claim 1, wherein at least the first electrode is substantially permeable to the vaporized material.

6. The cartridge of claim 1, wherein at least the second electrode is substantially permeable to airflow passing through the airflow passageway.

7. The cartridge of claim 1, wherein the airflow tube includes a porous element that is in fluid communication with the reservoir, the porous element being configured to recycle a portion of the liquid vaporizable material within the airflow passageway back into the reservoir.

8. The cartridge of claim 1, wherein the first electrode is a first metal plate and the second electrode is a second metal plate.

9. A cartridge for a vaporizer device, the cartridge comprising:

a reservoir being configured to contain a liquid vaporizable material, the liquid vaporizable material including at least one ionic component;

an airflow tube that extends though the reservoir and defines an airflow passageway therethrough; and a conduit in fluid communication with the reservoir and the airflow passageway such that at least a portion of the liquid vaporizable material can be received therethrough, the conduit being bound by opposed sidewalls defining first and second electrodes, wherein the liquid vaporizable material received within the airflow passageway conducts electric current and is substantially vaporized in response to generation of a potential difference between the first and second electrodes.

10. The cartridge of claim 9, wherein the first electrode and the second electrode are each configured to be in electrical communication with a power source, and wherein activation of the power source results in ohmic heating and vaporization of at least a portion of the liquid vaporizable material received within the conduit.

11. The cartridge of claim 9, wherein the first electrode and the second electrode are each configured to be in electrical communication with a power source, and wherein activation of the power source results in capacitive heating and vaporization of at least a portion of the liquid vaporizable material received within the conduit.

12. The cartridge of claim 9, wherein the generated potential difference is configured to substantially cease in response to a resistance between the first electrode and the second electrode exceeding a predetermined threshold resistance.

13. The cartridge of claim 9, wherein at least the first electrode is substantially permeable to the vaporized material.

14. The cartridge of claim 9, wherein at least the second electrode is substantially permeable to airflow passing through the airflow passageway.

15. The cartridge of claim 9, wherein the airflow tube includes a porous element that is in fluid communication with the reservoir, the porous element being configured to recycle a portion of the liquid vaporizable material within the airflow passageway back into the reservoir.

16. A vaporizer device, comprising:

a vaporizer body; and a cartridge that is selectively coupled to and removable from the vaporizer body, the cartridge including:

a reservoir being configured to contain a liquid vaporizable material, the liquid vaporizable material including at least one ionic component, an airflow tube that extends though the reservoir and defines an airflow passageway therethrough, the airflow tube including a wicking element that is in fluid communication with the reservoir, the wicking element being configured to substantially draw at least a portion of the liquid vaporizable material from the reservoir into the airflow passageway, and a first electrode and a second electrode positioned substantially on or adjacent to opposite surfaces of the wicking element, wherein the liquid vaporizable material received within the wicking element conducts electrical current and is substantially vaporized in response to generation of a potential difference between the first and second electrodes.

17. The device of claim 16, wherein the vaporizer body includes a power source that is configured to be in electrical communication with the first electrode and the second electrode.

18. The device of claim 17, wherein activation of the power source results in ohmic heating and vaporization of at least a portion of the liquid vaporizable material received within the wicking element.

19. The device of claim 17, wherein activation of the power source results in capacitive heating and vaporization of at least a portion of the liquid vaporizable material received within the wicking element.

20. The device of claim 16, wherein the generated potential difference is configured to substantially cease in response to a resistance between the first electrode and the second electrode exceeding a predetermined threshold resistance.

* * * * *